US007214873B2

(12) United States Patent
Shiobara

(10) Patent No.: US 7,214,873 B2
(45) Date of Patent: May 8, 2007

(54) ELECTRICAL TRANSMISSION LINE AND A SUBSTRATE

(75) Inventor: Syunsuke Shiobara, Tokyo (JP)

(73) Assignee: Agilent Technologies, Inc., Palo Alto, CA (US)

( * ) Notice: Subject to any disclaimer, the term of this patent is extended or adjusted under 35 U.S.C. 154(b) by 23 days.

(21) Appl. No.: 11/133,684

(22) Filed: May 20, 2005

(65) Prior Publication Data

US 2005/0257948 A1 Nov. 24, 2005

(30) Foreign Application Priority Data

May 24, 2004 (JP) ..... 2004-153236

(51) Int. Cl.
*H01B 7/34* (2006.01)

(52) U.S. Cl. ..... 174/36

(58) Field of Classification Search ..... 174/110 R, 174/117 F, 117 FF, 32, 33, 34, 36
See application file for complete search history.

(56) References Cited

U.S. PATENT DOCUMENTS

| | | | | |
|---|---|---|---|---|
| 3,528,173 | A * | 9/1970 | Gall | 29/839 |
| 3,530,229 | A * | 9/1970 | Burke, Jr. | 174/252 |
| 3,564,115 | A * | 2/1971 | Gribble et al. | 174/254 |
| 5,363,280 | A * | 11/1994 | Chobot et al. | 361/794 |
| 6,235,994 | B1 * | 5/2001 | Chamberlin et al. | 174/252 |
| 6,271,740 | B1 | 8/2001 | Chikamatsu | 335/151 |
| 6,462,281 | B2 | 10/2002 | Uchida et al. | 174/138 |

FOREIGN PATENT DOCUMENTS

| | | |
|---|---|---|
| JP | 08335754 | 12/1996 |

* cited by examiner

*Primary Examiner*—William H. Mayo, III

(57) ABSTRACT

An electrical transmission line has an electrical wire, a guard pattern disposed parallel to the electrical wire, and a plurality of insulation studs fastened to the guard pattern for separating the electrical wire and the guard pattern. The guard pattern has a non-conductive region disposed around the part where the insulation studs are fastened and a wiring pattern for electrically connecting the conductive region to the outside of the non-conductive region and the studs.

3 Claims, 5 Drawing Sheets

ELECTRICAL TRANSMISSION LINE AND A SUBSTRATE

1. FIELD OF THE INVENTION

The present invention relates to an electrical transmission line for transmitting microcurrents and in particular, to an electrical transmission line wherein the air-wired electrical wire and guard pattern are separated by an insulation stud, as well as a substrate on which the guard pattern is formed.

2. DISCUSSION OF THE BACKGROUND ART

Equipment for measuring microcurrents and a circuit with microcurrent output sensors, as well as other equipment for handling microcurrents often has an electrical transmission line that has been air-wired in order to prevent contamination by outside current or leakage current generated when the microcurrent is transmitted (refer to JP (Kokai) 8[1996]-335,754). A guard pattern of the same potential as the air-wired electrical transmission line is generally made around the transmission line in order to prevent direct-current leakage current from flowing around the transmission line and to prevent charge current from flowing to the floating capacitance formed around the transmission line.

FIG. 4 is a typical example of an electrical transmission line 50 with a guard pattern 30. Guard pattern (conductive region) 30 is formed parallel to an electrical wire 20 that transmits microcurrents on a substrate 40. A plurality of studs 10 are disposed in guard pattern 30 along electrical wire 20. Electrical wire 20 and guard pattern 30 are separated by supporting the electrical wire 20 using insulation studs 10.

An example of a typical insulation stud 10 is shown in FIG. 3. Insulation stud 10 is a cylindrical insulator 12 made from Teflon (registered trademark) with a top electrode 11 and a bottom electrode 13 at either end. Electrical wire 20 is anchored by soldering it onto electrode 11. Moreover, insulation stud 10 is anchored to guard pattern 30 by joining guard pattern 30 and electrode 13 by soldering.

However, the temperature around electrical transmission line 50 changes over time. Because of this, the surface area contacting the atmosphere and the heat capacity differ between top electrode 11 and bottom electrode 13 connected to guard pattern 30; therefore, the rate of change in temperature at the two electrodes is not the same. As a result, a temperature difference is produced between the two electrodes while the peripheral temperature changes. When this occurs, a thermally stimulated current is produced in accordance with the temperature difference of insulator 12 and this current flows into electrical wire 20. In general, this thermally stimulated current is a very small microcurrent (usually on the order of several femtoamperes to several hundred femtoamperes), but the fact of thermally stimulated current cannot be disregarded when the current flowing to electrical wire 20 is a microcurrent on the same order as the thermally stimulated current or when the transmitted current must be measured at the same resolution as the thermally stimulated current.

There are methods whereby electrical transmission line 50 is closed in order to eliminate as much as possible the effects of peripheral temperature changes and thereby to control the thermally stimulated current. However, when the transmission line is closed, the effect of internal heat generation increases and there is an increase in the possibility of current leakage, and similar effects occurring due to the presence of humidity trapped inside the closed area. Therefore, it is preferred that the difference in the amount of temperature change between top electrode 11 and bottom electrode 13 be reduced without closing the electrical transmission line.

Bottom electrode 13 and guard pattern 30 can be thermally separated in order to accomplish this, but when bottom electrode 13 and guard pattern 30 are completely electrically separated, bottom electrode 13 enters a state where it is said to be floating electrically and it becomes impossible to prevent direct-current leakage current from floating around the transmission line or to prevent the charge current from flowing to floating capacitance produced around the line because the line is not completely guarded. Therefore, it is preferred that bottom electrode 13 and guard pattern 30 be electrically connected while preventing heat conduction between the two.

SUMMARY OF THE INVENTION

The present invention solves the above-mentioned problem with an electrical transmission line comprising an electrical wire, a guard pattern disposed parallel to the electrical wire, and a plurality of insulation studs inserted between the electrical wire and the guard pattern, this electrical transmission line being characterized in that the guard pattern has a non-conductive region disposed around the part where the insulation studs are fastened as well as a wiring pattern for electrically connecting the conductive region to the outside of the non-conductive region and the studs.

That is, it is possible to reduce the contact surface area between the bottom electrode and the conductive region (guard pattern) and to reduce the amount of heat conducted over a specific time by connecting the two by a linear pattern and not by a plane. When this is done, it is possible to control the effect of temperature changes of the conductive region on temperature changes of the bottom electrode; therefore, the temperature difference generated between the top electrode and the bottom electrode of the stud can be reduced, even in the case of changes in surrounding temperature. On the other hand, current does not flow between the bottom electrode and the conductive region (guard pattern); therefore, the contact surface area is reduced and the bottom electrode can be kept at the same potential as the guard pattern even if the resistance of the connection wiring increases.

The present invention provides an electrical transmission line with which the effect of thermally stimulated current is small, as well as a substrate which is used in this transmission line.

DETAILED DESCRIPTION OF THE PREFERRED EMBODIMENT

Figure 1:
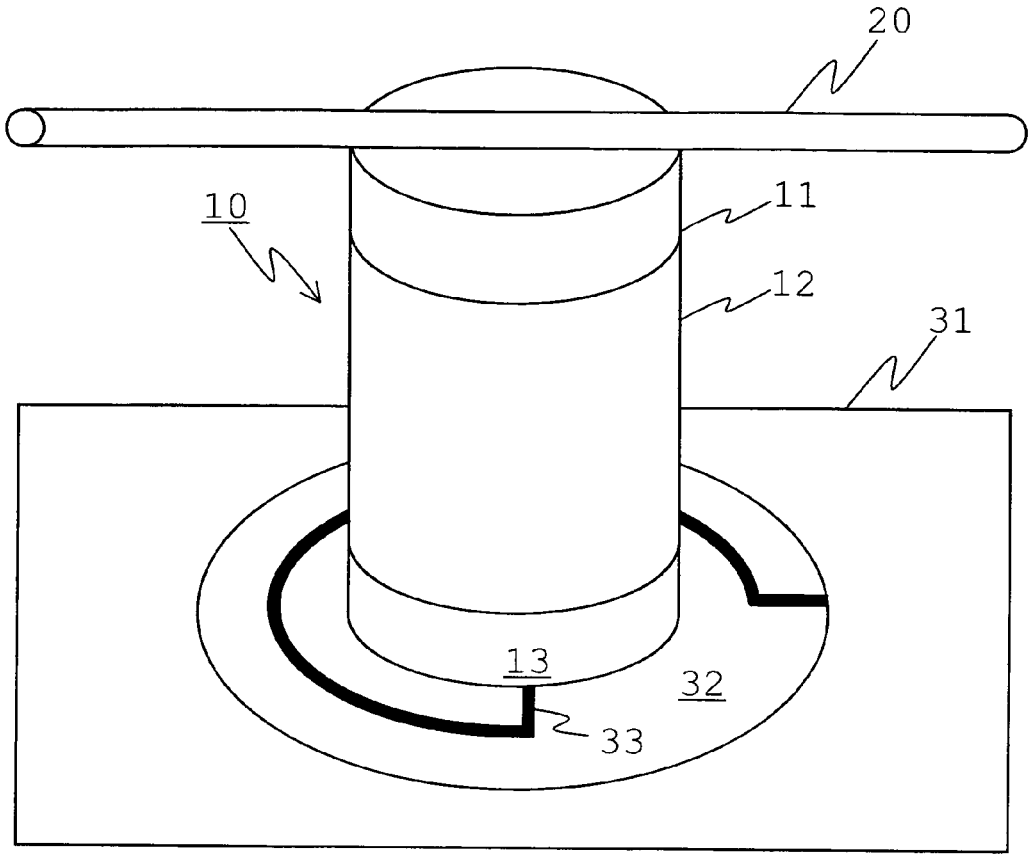
FIG. 1 is an enlarged view of the area near the stud of the working example of the present invention.

Preferred embodiments of the present invention will now be described in detail while referring to the drawings.

Figure 2:
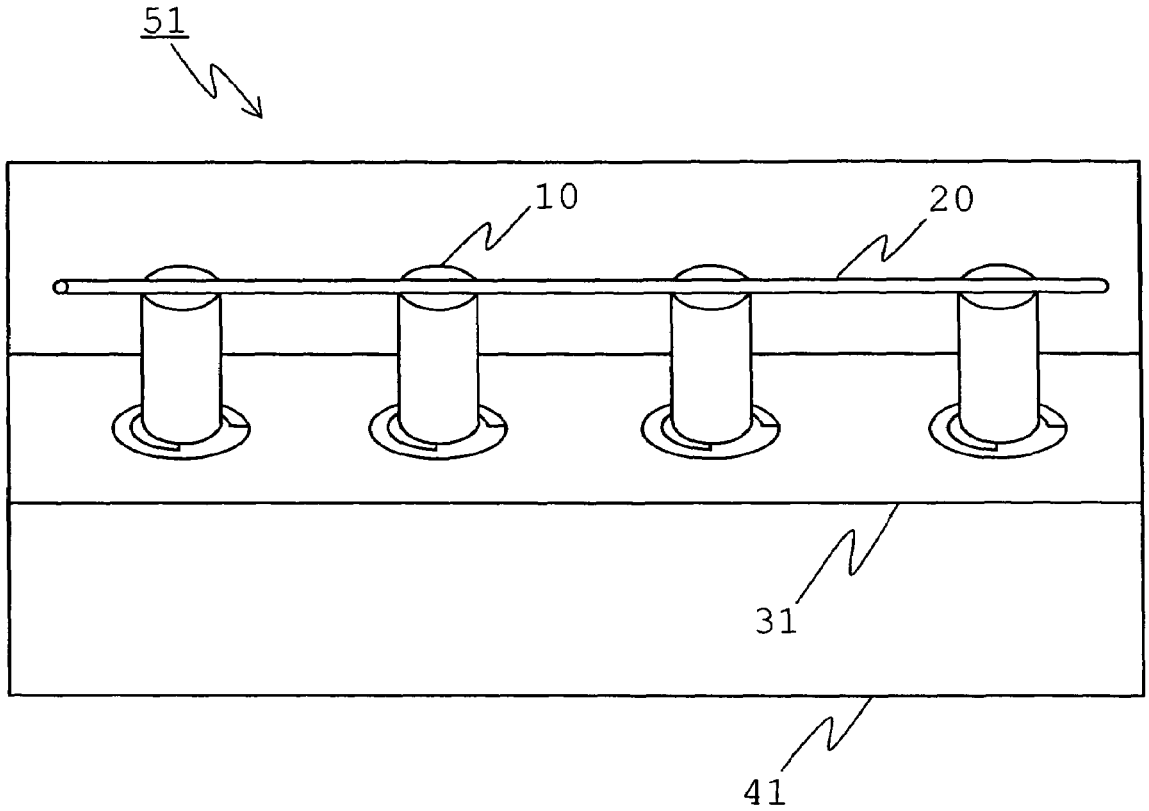
FIG. 2 is a working example of the current conduction line pertaining to the present invention.
Figure 3:
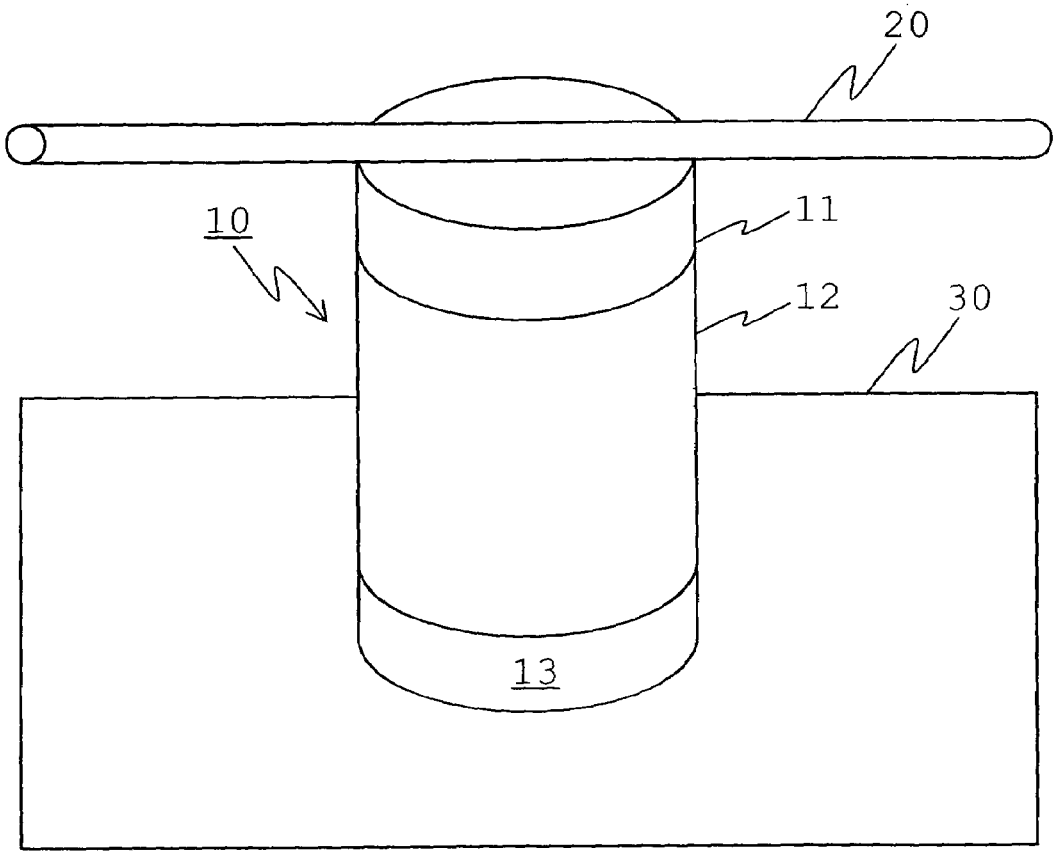
Fig. 3 PRIOR ART
FIG. 3 is an enlarged view of the region near the stud of a working example of the prior art.
Figure 4:
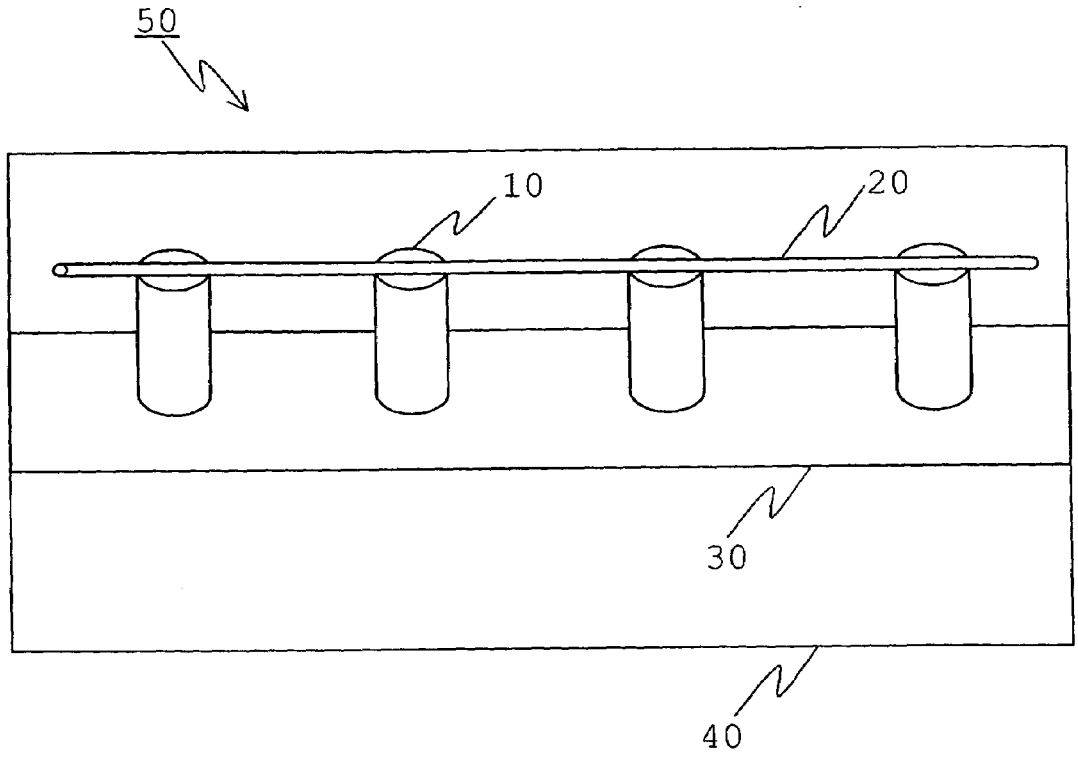
Fig. 4 PRIOR ART
FIG. 4 is a working example of an electrical transmission line pertaining to the prior art.

FIG. 2 shows an electrical transmission line 51 pertaining to the present invention, and FIG. 1 shows an enlarged view near the part where an insulation stud 10 is fastened and a conductive region 31 is formed. Guard pattern (conductive region) 31 is made on a substrate 41 parallel to electrical wire 20 to which microcurrent is transmitted. Guard pattern 31 is set at the same potential as the electrical wire 20. Guard pattern 31 of the present working example is simply a plane pattern made on printed substrate 41, but a spatial enclosure can also be formed using a copper, aluminum, or other metal plate. That is, it is possible to control the leakage current from electrical wire 20 and the charge current to floating capacitance by covering with metal foil the region where air wiring is disposed in order to separate it from the outside space and by applying voltage of the same potential as that of electrical wire 20 to this metal structure.

A plurality of non-conductive regions 32 are disposed in guard pattern 31 parallel to electrical wire 10. Non-conductive region 32 of the present working example is made by etching in a circle around the part of the conductive region 31 where insulation stud 10 is fastened. Of course, the method by which non-conductive region 32 is made is not limited to etching, and this non-conductive region can be made by forming holes, or another method. Electrical wire 20 and guard pattern 31 are separated by insulation stud 10 and are in an electrically non-conducting state.

Insulation stud 10 is a cylindrical insulator 12 with a top electrode 11 and a bottom electrode 13 at either end. Insulator 12 is made from Teflon (registered trademark). Electrodes 11 and 13 are made from a brass plated with a nickel foundation and a gold, but gold, nickel, or another metal with high electrical conductivity can also be used. Electrical wire 20 is anchored to top electrode 11 by soldering.

Figure 5:
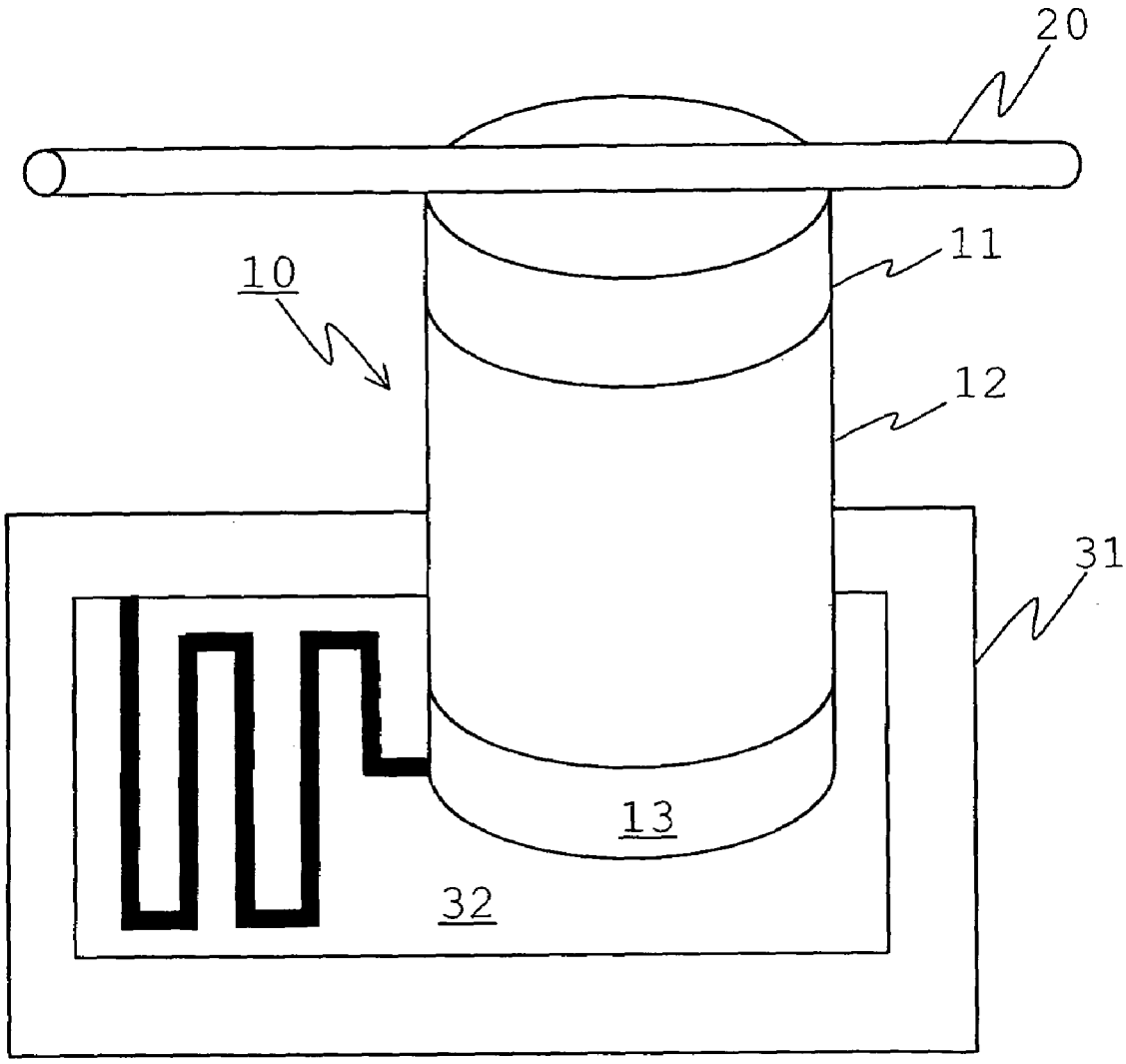
FIG. 5 is a diagram of another wiring pattern pertaining to the present invention.

A wiring pattern 33 for electrically connecting bottom electrode 13 and conductive region 31 is disposed in non-conductive region 32. Wiring pattern 33 is made by masking a region for this wiring pattern 33 in order to leave a conductive region when non-conductive region 32 is made by etching. As long as wiring pattern 33 is long, the amount of heat transmitted over a specific time between the bottom electrode 13 and conductive region 31 will decrease along this length. Therefore, it is preferred that wiring pattern 33 is longer than the distance between stud 10 and conductive region 31. However, heat is also transmitted through glass epoxy substrate 41; therefore, even if the heat conductivity of wiring pattern 33 is less than the conductivity of substrate 41, any increase in this effect is undesirable. By means of the present working example, a long pattern is made by making wiring pattern 33 go ¾ of the way around the stud, parallel to the part where stud 10 is fastened, but a spiral-shaped pattern can also be used in order to produce a long wiring pattern 33. Moreover, the zigzag-shaped pattern in FIG. 5 can be used in place of a pattern parallel to the outside periphery of the part where stud 10 is fastened. The amount of heat transmitted decreases as the line width of wiring pattern 33 becomes narrower. Wiring with a line width of 150 microns is used in the present working examples.

The technical concept of the present invention has been described in detail while referring to a specific working example, but it is clear that persons skilled in the art to which the present invention belongs can make various changes and modifications that do not stray from the gist or the scope of the claims.

What is claimed is:

1. An electrical transmission line comprising:

an electrical wire, a guard pattern disposed parallel to the electrical wire, and a plurality of insulation studs fastened to the guard pattern for separating the electrical wire and the guard pattern, said guard pattern comprising a non-conductive region disposed around a part where the insulation studs are fastened and a wiring pattern for electrically connecting the conductive region to an outside of the non-conductive region and the insulation studs reducing a temperature difference between a top and a bottom of the insulation studs.

2. The electrical transmission line according to claim 1, wherein the wiring pattern has a length that is longer than a space between the insulation studs and the conductive region.

3. The electrical transmission line according to claim 2, wherein the wiring pattern is disposed parallel to the outside periphery of a part where the stud is fastened.

* * * * *